United States Patent [19]

Grossman

[11] 4,137,929

[45] Feb. 6, 1979

[54] FINGERNAIL CLEANER

[76] Inventor: Peter J. Grossman, 6064 Mohler St., San Diego, Calif. 92120

[21] Appl. No.: 820,082

[22] Filed: Jul. 29, 1977

[51] Int. Cl.[2] ..... B08B 3/02

[52] U.S. Cl. ..... 134/182; 134/191; 134/198; 4/165; 132/73

[58] Field of Search ..... 134/182–183, 134/191, 198–201; 128/366, 368; 4/1, 165; 132/73, 75

[56] References Cited

U.S. PATENT DOCUMENTS

| | | | |
|---|---|---|---|
| 1,753,044 | 4/1930 | Culver | 132/73 |
| 2,169,990 | 8/1939 | Preve | 132/73 |
| 3,757,806 | 9/1973 | Bhaskar | 134/199 X |
| 3,918,987 | 11/1975 | Kopfer | 134/199 X |
| 3,982,965 | 9/1976 | Spotz | 4/165 X |

OTHER PUBLICATIONS

*Article Cleaning Apparatus,* IBM Technical Disclosure Bulletin, 5/67, p. 1740.

*Primary Examiner*—Robert L. Bleutge
*Attorney, Agent, or Firm*—Brown & Martin

[57] ABSTRACT

A fingernail cleaner comprising an enclosed fingernail receiving receptacle having an opening in the upper end for receiving one or more of a person's fingers to be cleaned, which opening fits closely around the fingers to prevent liquid from splashing out through the opening, and a liquid nozzle for spraying liquid at one or more angles behind the end of the fingernail for cleaning the fingernail, with a drain at the bottom of the receptacle for draining the liquid from the recptacle, and a selective source of liquid for providing a pulsating liquid stream to the nozzle.

8 Claims, 4 Drawing Figures

FINGERNAIL CLEANER

BACKGROUND OF THE INVENTION

There are many jobs, positions and professions that requires a person to clean their fingers and fingernails from time to time; examples being hospitals, restaurants, manicurists and the like. However, it is often rather difficult to clean one's nails and do so with that degree of cleanliness required. Only persons who have to clean their fingernails often recognize and realize this difficulty. Oftentimes cleaning one's fingernails requires the use of scrub brushes that over a period of time can be damaging to the ends of one's fingers, or the use of objects such as sharp bladed instruments or the like that usually do not do a good job and the continued use of which can be damaging to one's fingernails.

So it is advantageous to have a new and improved device that will quickly, efficiently and inexpensively, clean one's fingernails either one at a time or several at a time, in a quick and easy fashion using prepared liquid chemicals if desired, or water or the like; and which device is not injurious to one's fingers even though used often each day.

SUMMARY OF THE INVENTION

In an illustrative embodiment of this invention, the fingernail cleaner comprises an enclosed finger receptacle that has an opening in the upper end for receiving one or more of a user's fingers. The receptacle is enclosed for containing a stream of liquid. A liquid jet nozzle means is positioned in the receptacle for receiving liquid under pressure and jetting a liquid stream against the underside of the end of a person's fingernails when positioned in the receptacle. The opening in the top of the receptacle in another embodiment is curved and fitted for receiving several fingers, and the nozzle means is elongated with a plurality of jets for cleaning several fingernails simultaneously. A drain in the lower portion of the receptacle immediately drains the liquid out of the receptacle so that the liquid that contacts the ends of the user's fingers, carries the dirt away along with the liquid and does not stay in the receptacle.

The liquid nozzle means may comprise one or more nozzles that jets liquid or cleaning fluid at an angle against the underside of the fingernails, or may comprise a curved tube having liquid jet openings along the length thereof, to spray liquid in a plurality of streams against the reverse side of the fingernail of one whole hand, providing a device for more rapidly cleaning fingernails.

The source of the liquid may be water from a normal hydrant connection, if the local water supply has sufficient pressure. In other cases, the liquid may be obtained from a reservoir and pumped by a pulsing motor, that provides liquid in pulsating, pressure discharge stream from the nozzle. Also the water or liquid may be pumped from a reservoir containing sterilizing chemicals, soap or the like, to aid in the cleaning operation.

The entire unit may be packaged into a single package with the finger cleaning receptacle positioned on the upper side and with a pump and motor positioned under said finger receptacle, and with the water drain positioned in the bottom of the finger receptacle.

It is therefore an object of this invention to provide a new and improved fingernail cleaner.

Other objects and many advantages of this invention will become more apparent upon a reading of the following detailed description and an examination of the drawings, wherein like reference numerals designate like parts throughout and in which.

Figure 1:
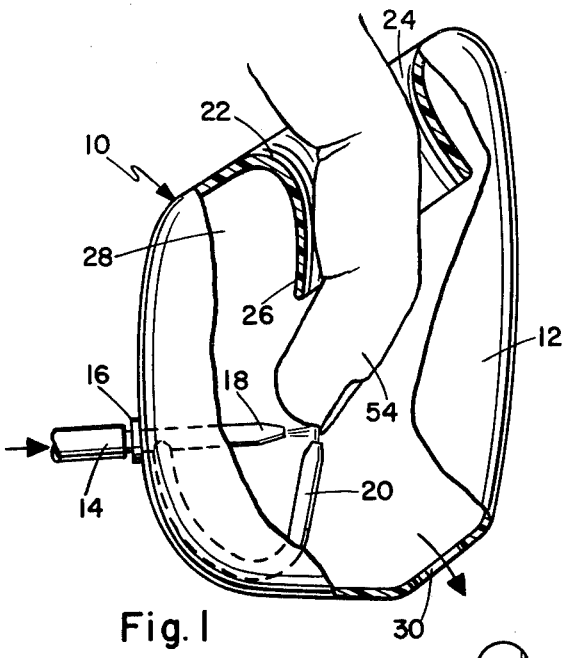
FIG. 1 is a side elevation view, partially cut away, of one form of the fingernail cleaner.

Referring now to the drawing and specifically to FIG. 1, a finger receptacle 10 has a receptacle housing 12 that is enclosed and is made of liquid impervious material. The receptacle has an upper opening 24 with a curved inward tubular projection 26 that substantially encloses around a person's single finger, and which as a smooth surface 22 for receiving the finger 54. This receptacle 10 is specifically for cleaning or washing one fingernail at a time. The lower end of the receptacle has nozzle means comprising a pair of nozzles 18 and 20, that receive liquid, water or a suitable cleaning fluid through a conducting tube 14 and directed to a position to engage the ends of the finger and the fingernails. Connection 16 passes the tube 14 or the like through the receptacle wall 12. The first nozzle 18 jets the liquid stream underneath the end of the fingernail of finger 54, and the nozzle 20 with the curved connecting tube jets liquid into the end of the fingernail, cleaning dirt and the like from the deeper crevises of the space behind the fingernail. It may be recognized in use that the person's finger 54 will be guided by the tubular projection 26 to a particular general position to feel the pressure of the liquid washing stream, and can be moved around in the receptacle to clean various portions of the fingernail. While only one nozzle 18 may be employed, it is advantageous to have both nozzles 18 and 20.

The receptacle 12 also has an opening 30 in the lower end thereof through which the liquid, water or other fluid passes readily out to an appropriate drain. It may be understood that opening 30 is sufficiently low in the receptacle 12 and is sufficiently large, so that there is no pooling of the water within the receptacle 12 into which finger 54 could project. Thus finger 54 is only contacted by liquid from the respective nozzles 18 and 20, and is not projected into a pool of dirty liquid in receptacle 12.

Figure 4:
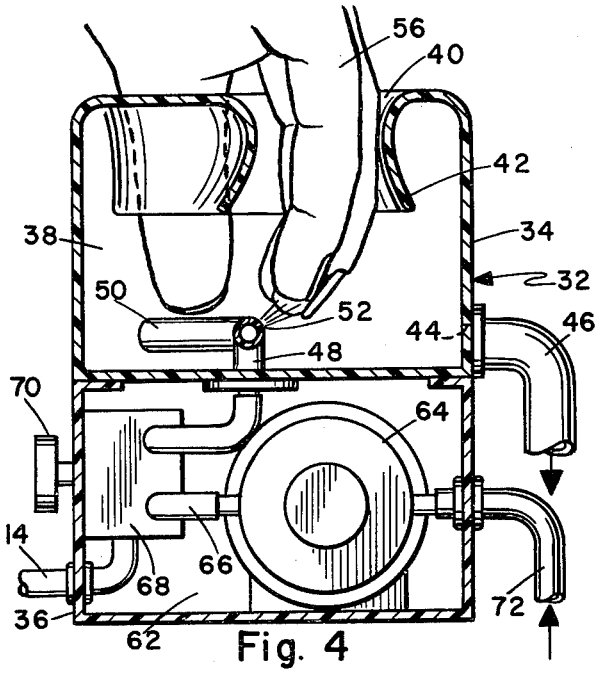
FIG. 4 is a sectional view taken on line 4—4 of FIG. 3.
Figure 2:
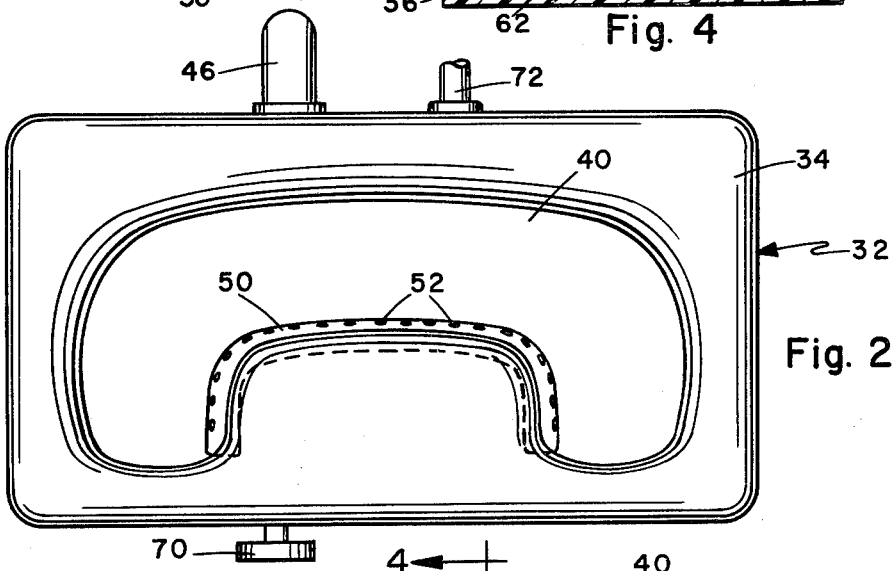
FIG. 2 is a top plan view of an alternative form of the cleaner for washing all of the fingernails of one hand together.
Figure 3:
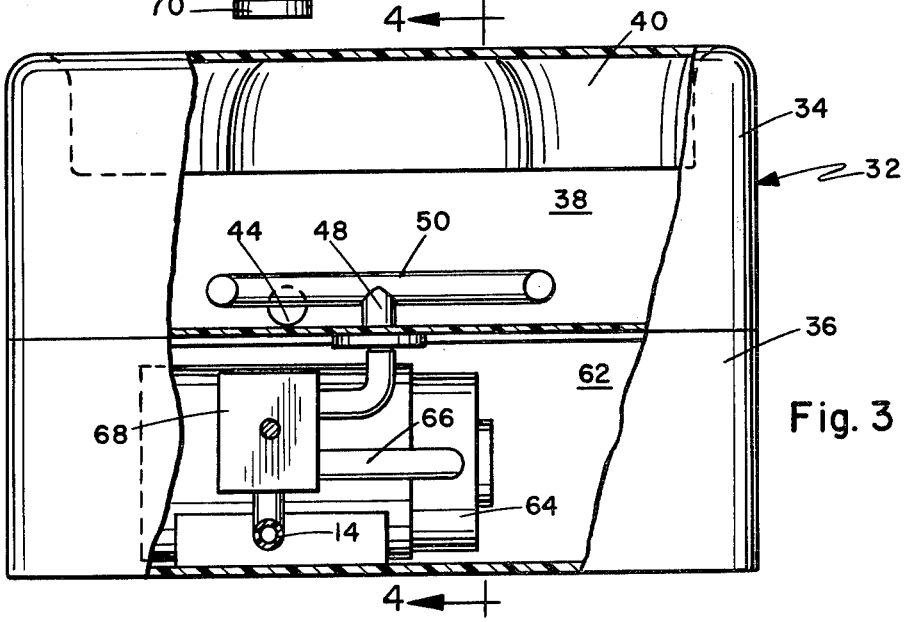
FIG. 3 is a front elevation view, partially cut away, of the structure of FIG. 2.

Referring now to FIGS. 2, 3 and 4, a fingernail cleaning receptacle 32 has an upper enclosed portion 34 and a lower enclosed portion 36. The upper portion 34 comprises a water tight container with an elongated opening 40 for receiving all of the fingers 56 of one hand. Fingers 56 project through the opening 40 in the manner illustrated. Liquid passes from a suitable source, to be described hereinafter, through conduit 48 and through an elongated tubular member such as a pipe conduit or the like 50 that has a plurality of jet openings 52 that jet the liquid under pressure against the back of the fingernails of the fingers 56. The water, liquid or cleaning fluid is jetted at a substantially 45° angle or other suitable acute angle. The fingers 56 would by feel and the touch of the liquid stream be selectively positioned in the space 38, so that the stream through jets 52 contact the back of the fingernails in the washing action. The liquid after contacting the fingernails 52 collects in the bottom of the space 38 and passes out through opening 44 and through conduit 46 into a suitable drain. Opening 44 is sufficiently large so that it will more than handle all of the liquid passing out through conduit 48.

The upper end 34 of receptacle 32 has a curved inwardly projected generally tubular opening wall 42 that has a smooth inner surface for receiving the fingers 56, and yet is so designed as to fit snuggly around the fingers 56 so that the liquid passing out of conduit 50 and jets 52 will not spray out the opening 40 when in operation.

The lower container 36 forms a base for the upper receptacle 34 and houses a pump motor 64. Pump motor 64 receives liquid, water, cleaning fluid or the like from a suitable source through conduit 72. Pump motor 64 provides an output fluid delivery under pressure that may be pulsating to obtain maximum washing force. The discharged liquid passes out through conduit 66 and through line 48 and through conduit 50 to the jet openings 52.

It may be understood that a valve handle 70 may close a valve 68 in line 66, so that liquid from the pump 64 passes out through conduit 14 for use in the single finger receptacle 12. Also, it may be understood that liquid may be passed from a hydrant or other separate source into conduit 14 in both embodiments of FIG. 1 and FIGS. 2, 3 and 4. This could be normal water delivery from a faucet or the like. It may also be understood that there may be a reservoir, not shown, of liquid such as water, cleaning fluid or the like, that communicates with line 72 as a source for pump 64. It can be recognized that there are many different arrangements for providing suitable liquid pressure separate from a domestic water supply, such as a pressurized reservoir that may be pressurized by $CO_2$ or the like.

Having described my invention, I now claim:

1. A fingernail cleaner for cleaning a user's fingernails comprising, an enclosed finger receiving receptacle having an opening in the upper end having an inwardly projecting tubular rim with a substantially smooth inner surface that fits closely around the finger for guiding the finger to a general position within the receptacle and for restricting the spraying of water around the finger and out the opening and adapted for receiving solely the fingers and at least one finger, liquid nozzle means positioned in said receptacle for receiving liquid under pressure and jetting a liquid stream solely at a position to engage the ends of the finger and against the underside of the end of the fingernail when positioned in said receptacle, and drain opening means in the lower part of said receptacle for draining the liquid out of said receptacle.

2. A fingernail cleaner as claimed in claim 1 wherein, said liquid nozzle means comprising a first nozzle and a second nozzle, said first nozzle directing a liquid stream at an angle substantially normal to the end of the fingernail, and said second nozzle directing liquid in a direction toward the end of the fingernail and substantially parallel with and slightly behind the outer end of the fingernail.

3. A fingernail cleaner as claimed in claim 2 including, a reservoir of liquid, and pump means for pumping said liquid to said liquid nozzle means in a high pressure, pulsing stream.

4. A fingernail cleaner as claimed in claim 1, wherein, said opening having an arcuate shape with space for receiving all the fingers of one hand.

5. A fingernail cleaner as claimed in claim 4 wherein, said liquid nozzle means comprising a curved liquid conduit, having jet opening means spaced along the length thereof for jetting liquid streams at a side directed acute angle to contact the underside of the fingernails.

6. A fingernail cleaner as claimed in claim 4 including, means for connecting said liquid nozzle means to a source of high pressured liquid.

7. A fingernail cleaner as claimed in claim 4 including, a reservoir of liquid, pump means comunicating with said liquid nozzle means for pumping liquid in a pulsating, high pressured stream to said liquid nozzle means.

8. A fingernail cleaner as claimed in claim 7 wherein, said liquid nozzle means comprising an upper compartment, a lower compartment supporting said upper compartment which lower compartment houses said pump, discharge conduit means from said pump communicating through the inner connecting wall between said lower chamber and said upper chamber for delivering liquid to said nozzle means, and said drain opening being positioned at the lower wall of said upper compartment.

* * * * *